US005465740A

United States Patent [19]

Kim

[11] Patent Number: 5,465,740

[45] Date of Patent: Nov. 14, 1995

[54] BATTERY OPERATED NAIL FILE APPARATUS

[76] Inventor: Tae S. Kim, 122-12 20th Ave., College Point, N.Y. 11356

[21] Appl. No.: 231,732

[22] Filed: Apr. 25, 1994

[51] Int. Cl.[6] ..... A45D 29/05; A45D 29/18

[52] U.S. Cl. ..... 132/73.6; 132/76.4

[58] Field of Search ..... 132/73.6, 75.6, 132/75.8, 76.4

[56] References Cited

U.S. PATENT DOCUMENTS

| | | | |
|---|---|---|---|
| 1,742,862 | 1/1930 | Jones | 132/75.8 |
| 2,644,972 | 7/1953 | Ubel | 132/73.6 |
| 2,880,737 | 4/1959 | Tone et al. | 132/73.6 |
| 3,916,921 | 11/1975 | Pesola | 132/73.6 |

*Primary Examiner*—John G. Weiss
*Assistant Examiner*—Elise P. Speaks
*Attorney, Agent, or Firm*—Michael I. Kroll

[57] ABSTRACT

A nail file apparatus is provided which consists of a housing with a handle extending from a rear portion of the housing. A nail file has a tip portion, a heel portion and ridges therebetween. A mechanism within said housing is for causing a reciprocating movement. A structure is for coupling the heel portion of the nail file to the reciprocating movement mechanism at a front portion of the housing. A person can grip the handle and activate the reciprocating movement mechanism, to operate the nail file extending therefrom. The ridges will automatically smooth, polish and shape the fingernails.

1 Claim, 2 Drawing Sheets

BATTERY OPERATED NAIL FILE APPARATUS

BACKGROUND OF THE INVENTION

1. Field of the Invention

The instant invention relates generally to nail files and more specifically it relates to a battery operated nail file apparatus.

2. Description of the Prior Art

Numerous nail files have been provided in prior art that are small flat steel tools with hardened ridged surfaces used for smoothing, polishing and sharping the fingernails. While these units may be suitable for the particular purpose to which they address, they would not be as suitable for the purposes of the present invention as heretofore described.

SUMMARY OF THE INVENTION

A primary object of the present invention is to provide a battery operated nail file apparatus that will overcome the shortcomings of the prior art devices.

Another object is to provide a battery operated nail file apparatus that will produce even strokes for a more effective filing of the fingernails and will perform the task in less time, while require less effort than the traditional filing method.

An additional object is to provide a battery operated nail file apparatus in which the components will be made out of lightweight and durable materials.

A further object is to provide a battery operated nail file apparatus that is simple and easy to use.

A still further object is to provide a battery operated nail file apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4:
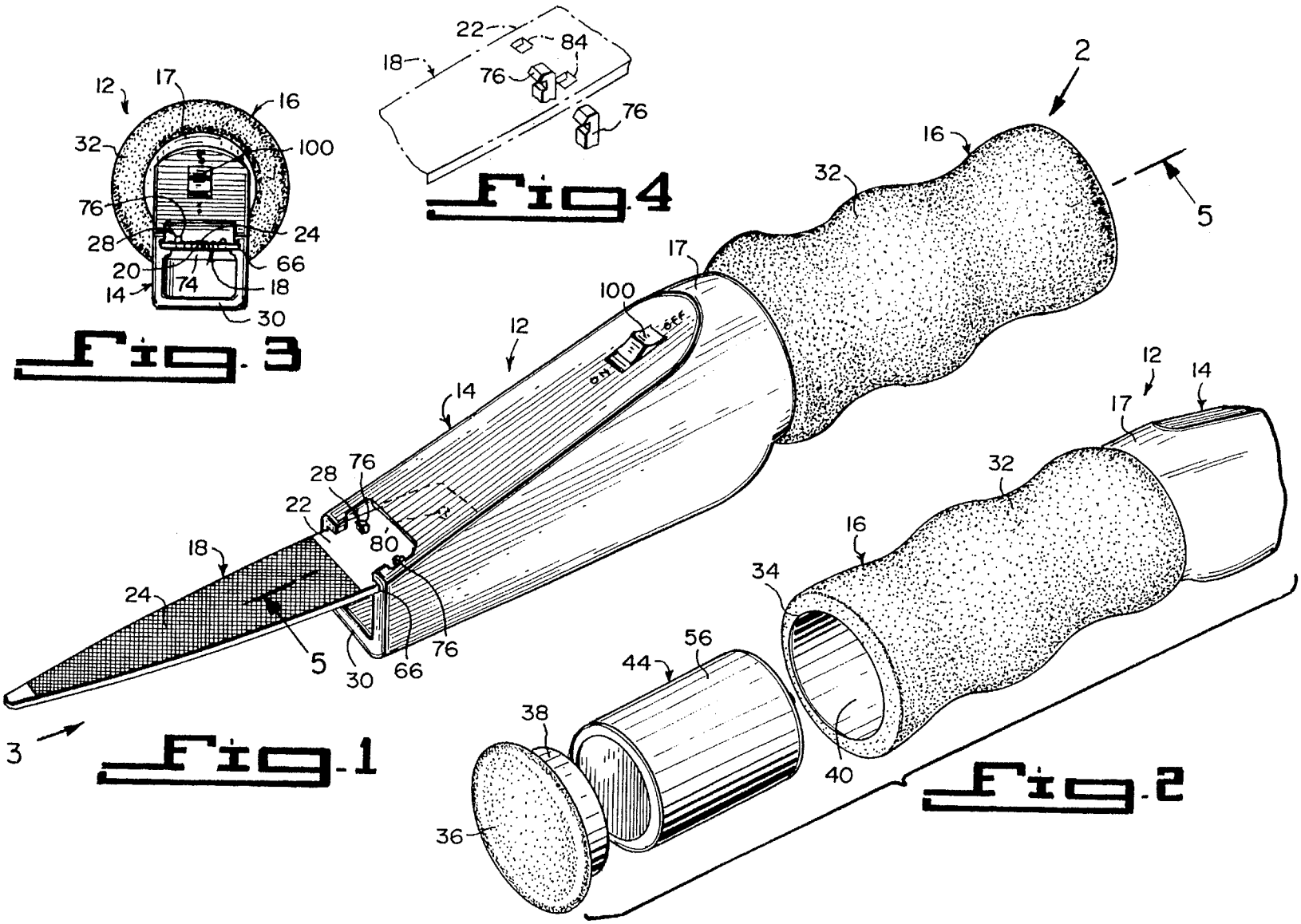
FIG. 1 is a front perspective view of the instant invention.
FIG. 2 is a rear exploded perspective view with parts broken away taken in the direction of arrow 2 in FIG. 1.
FIG. 3 is a front view taken in the direction of arrow 3 in FIG. 1.
FIG. 4 is a perspective view showing a rear portion of the nail file in phantom ready to be placed upon the forward stationary hooks.
Figure 5:
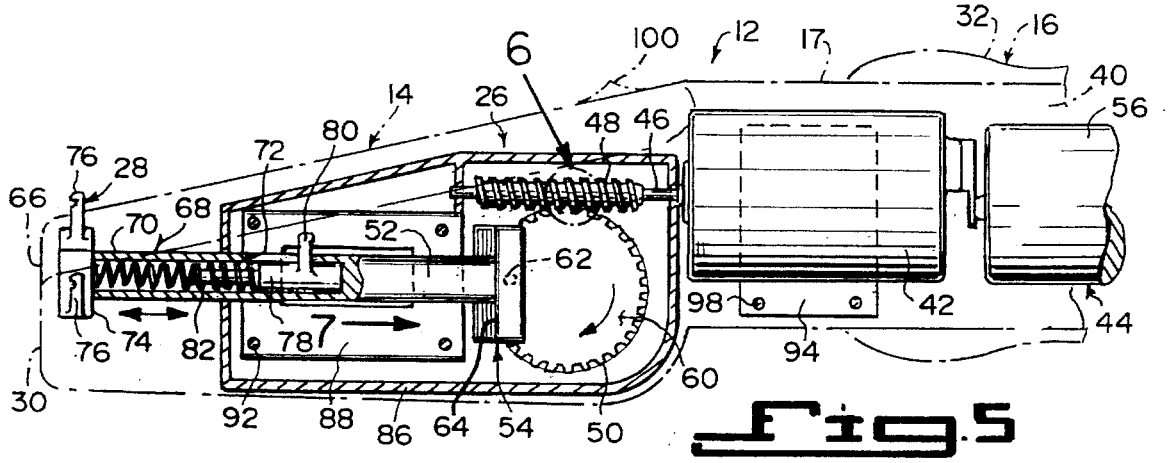
FIG. 5 is a cross sectional view taken along line 5—5 in FIG. 1, showing parts broken away and in phantom.
Figure 7:
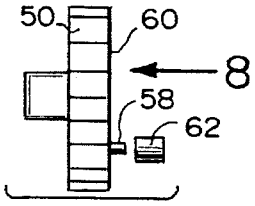
FIG. 7 is an end view of the worm gear taken in the direction of arrow 7 in FIG. 5, showing the roller exploded from the pin.
Figure 8:
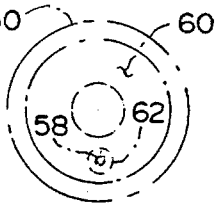
FIG. 8 is a side view of the worm gear in phantom taken in the direction of arrow 8 in FIG. 7.
Figure 6:
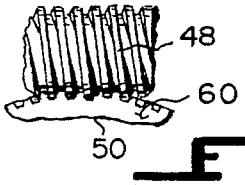
FIG. 6 is an enlarged view as indicated by arrow 6 in FIG. 5, showing a portion of the worm gear and the worm in greater detail.
Figure 9:
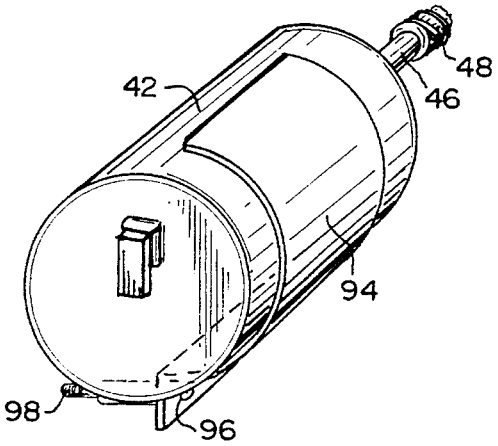
FIG. 9 is a rear perspective view of the electric motor and motor mount.
Figure 10:
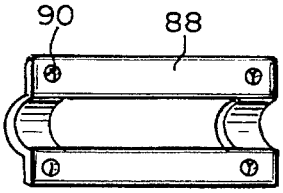
FIG. 10 is a side perspective view of the back-up bracket.
Figure 11:
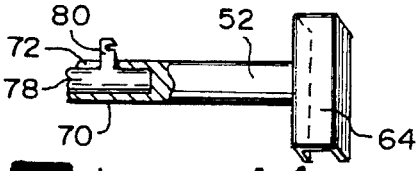
FIG. 11 is a side view partly in perspective with parts broken away and in section, showing part of the piston and nail file holder.

Turning now descriptively to the drawings, in which similar reference characters denote similar elements throughout the several views, FIGS. 1 through 11 illustrate a nail file apparatus 12 which comprises a housing 14, with a handle 16 extending from a rear portion 17 of the housing 14. A nail file 18 has a tip portion 20, a heel portion 22 and ridges 24 therebetween. A mechanism 26 within the housing 14 is for causing a reciprocating movement. A structure 28 is for coupling the heel portion 22 of the nail file 18 to the reciprocating movement mechanism 26 at a front portion 30 of the housing 14. A person can grip the handle 16 and activate the reciprocating movement mechanism 26 to operate the nail file 18 extending therefrom. The ridges 24 will automatically smooth, polish and shape the fingernails.

The handle 16 includes a padded hand grip 32 having an undulating surface, so that it can be grasped securely by the hand of the person. The handle 16 is hollow having a rear open end 34 and includes a padded end cap 36 with a collar 38 that fits into the rear open end 34 of the handle 16, so as to form a compartment 40 within the handle 16.

The reciprocating movement mechanism 26 contains an electric motor 42, with a portable power source 44 electrically connected to the electric motor 42. A drive shaft 46 extends from the electric motor 42, while a worm 48 is on the drive shaft 46. A worm gear 50 engages the worm 48 and a piston 52 is provided. A unit 54 is for pivotally connecting in an offset manner the piston 52 to the worm gear 50. When the worm gear 50 is turned by the worm 48 on the drive shaft 46 which is rotatable by the electric motor 42, the piston 52 will move horizontally back and forth. The portable power source 44 is a battery 56, insertable into the compartment 40 within the handle 16.

The pivotally connecting unit 54 includes a pin 58 mounted offset to a side 60 of the worm gear 50. A roller 62 is on the pin 58 rides in follower 64 (see FIG. 11) mounted to the piston 52, which engages thereby with the roller 62.

The coupling structure 28 consists of the housing 14 having a socket 66 formed in the front portion 30 thereof. A nail file holder 68 is integral with a forward end of the piston 52 at the socket 66 in the housing 14. The heel portion 22 of the nail file 18 can be retained by the nail file holder 68. The nail file holder 68 contains a hollow shaft 70 having a slot 72 therethrough. A stationary member 74 having a pair of spaced apart upstanding hooks 76 is attached transversely to a forward end of the hollow shaft 70, with the hooks 76 facing forward.

A movable member 78 78 has an upstanding hook 80 facing rearward. The movable member 78 rides within the hollow shaft 70 with the upstanding hook 80 through the slot 72. A spring 82 is carried within the hollow shaft 70 between the stationary member 74 and the movable member 78, so as to bias the movable member 78 away from the stationary member 74. The nail file 18 has three apertures 84 through the heel portion 22. When the heel portion 22 is inserted through the socket 66 in the housing 14, the hooks 76 on the stationary member 74 and the hook 80 on the movable member 78 will engage with the three apertures 84 in the heel portion 22 of the nail file 18.

A gear casing 86 is within the housing 14, for maintaining the drive shaft 46 with the worm 48 and the worm gear 50 in a cooperating condition therein. A back up bracket 88 is for supporting the piston 52 and a rear portion of the hollow shaft 70. The back up bracket 88 has a plurality of holes 90 therethrough. A plurality of fasteners 92 extend through the holes 90, for securing the back up bracket 88 within the gear casing 86. A forward portion of the hollow shaft 70 can extend through the gear casing 86 and into the socket 66 of the housing 14.

A motor mount 94 is for holding the electric motor 42. The motor mount 94 has a plurality of bores 96 therethrough. A plurality of bolts 98 are provided to extend through the bores 96, for securing the motor mount 94 within the housing 14 behind the gear casing 86. The reciprocating movement mechanism 26 further includes a switch 100 mounted onto the top of the housing 14 adjacent the rear portion 17, so as to be manually operated to turn the electric motor 42 on and off.

The nail file apparatus 12 is a free standing unit and measures approximately seven and three quarter inches in length and one and three quarter inches in width. The energy will be supplied by the 9-volt battery 56. The electric motor 42 is approximately one and one half inches by one inch and will run at nineteen hundred RPM. The worm gear 50 contains 20 teeth and will run at ninety five RPM. For those who prefer slower filing motion, the apparatus can be manufactured with the worm gear 50 containing 30 teeth and run at sixty three RPM. The worm gear 50 will interface with the worm gear 48, whereby each revolution of this gear 48 will move one tooth of the worm gear. The piston is approximately two and three quarter inches in length and one quarter inch in width and will contain the nail file holder 68 in the front portion 30, which will have the spring 82 measuring approximately one inch in length. The hooks 76 and the other hook 80 will attach to the metal nail file 18, measuring approximately five inches in length by one half inch in width. The nail file 18 will contain the three apertures 84 to facilitate attachment.

One complete revolution of all of the teeth of the worm gear 50 will cause one back and forth motion of the nail file 18. The sizes listed above are approximate and not limited to the apparatus 12.

LIST OF REFERENCE NUMBERS

| LIST OF REFERENCE NUMBERS | |
|---|---|
| 12 | nail file apparatus |
| 14 | housing |
| 16 | handle |
| 17 | rear portion of 14 |
| 18 | nail file |
| 20 | tip portion of 18 |
| 22 | heel portion of 18 |
| 24 | ridges on 18 |
| 26 | reciprocating movement mechanism |
| 28 | coupling structure |
| 30 | front portion of 14 |
| 32 | padded hand grip on 16 |
| 34 | rear open end of 16 |
| 36 | padded end cap |
| 38 | collar of 36 |
| 40 | compartment in 16 |
| 42 | electric motor |
| 44 | portable power source |
| 46 | drive shaft from 42 |
| 48 | worm on 46 |

-continued

| LIST OF REFERENCE NUMBERS | |
|---|---|
| 50 | worm gear |
| 52 | piston |
| 54 | pivotally connecting unit |
| 56 | battery for 44 |
| 58 | pin |
| 60 | side of 50 |
| 62 | roller |
| 64 | follower on 52 |
| 66 | socket in 30 |
| 68 | nail file holder |
| 70 | hollow shaft |
| 72 | slot in 70 |
| 74 | stationary member |
| 76 | upstanding hook on 74 |
| 78 | moveable member |
| 80 | upstanding hook on 78 |
| 82 | spring in 70 |
| 84 | aperture in 22 |
| 86 | gear casing |
| 88 | back up bracket |
| 90 | hole in 88 |
| 92 | fastener |
| 94 | motor mount |
| 96 | bore |
| 98 | bolt |
| 100 | switch |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A nail file apparatus which comprises:

a) a housing;

b) a handle extending from a rear portion of said housing including a padded hand grip having an undulating surface, so that it can be grasped securely by the hand of the person, said handle being hollow, having a rear open end and includes a padded end cap with a collar that fits into the rear open end of said handle, so as to form a compartment within said handle;

c) a nail file having a tip portion, a heel portion and ridges therebetween;

d) means within said housing, for causing a reciprocating movement including an electric motor, a portable power source comprising a battery inserted into the compartment within said handle electrically connected to said electric motor, a drive shaft extending from said electric motor, a worm on said drive shaft, a worm gear engaging with said worm, a piston, and means for pivotally connecting in an offset manner, said piston to said worm gear, so that when said worm gear is turned by said worm on said drive shaft which is rotatable by said electric motor, said piston will move horizontally back and forth, said pivotally connecting means including a pin mounted offset to a side of said worm gear, a roller on said pin, and a follower mounted to said piston which engages said roller;

e) means for coupling the heel portion of said nail file to said reciprocating movement means at a front portion of said housing so as to support said nail file at one end only, so that a person can grip said handle and activate said reciprocating movement means to operate said nail file extending therefrom, in which the ridges will automatically smooth, polish and shape fingernails, said coupling means including said housing having a socket formed in the front portion thereof, and a nail file holder integral with a forward end of said piston at said socket in said housing, so that the heel portion of said nail file can be retained by said nail file holder; and f) said nail file holder including a hollow shaft having a slot therethrough, a first member having a pair of spaced apart upstanding hooks attached transversely to a forward end of said hollow shaft, said hooks facing forward, a member movable with respect to said hollow shaft having an upstanding hook facing rearwardly, said movable member riding within said hollow shaft with said upstanding hook through said slot, a spring carried within said hollow shaft between said first member and said movable member, so as to bias said movable member away from said stationary member, and said nail file having three apertures through the heel portion, so that when the heel portion is inserted through said socket in said housing, the hooks on said stationary member and the hook on said movable member will engage with said three apertures in the heel portion of said nail file, and a back up bracket for supporting said piston and a rear portion of said hollow shaft, said back up bracket having a plurality of holes therethrough, and a plurality of fasteners to extend through said holes for securing said back up bracket within said gear casing, so that a forward portion of said hollow shaft can extend through said gear casing and into said socket of said housing, said nail file projecting from said apparatus being supported only at the heel portion thereof.

* * * * *